US010364551B2

(12) United States Patent
Fukuda et al.

(10) Patent No.: US 10,364,551 B2
(45) Date of Patent: Jul. 30, 2019

(54) WORK MACHINE

(71) Applicant: KUBOTA CORPORATION, Osaka (JP)

(72) Inventors: Yuji Fukuda, Osaka (JP); Ryosuke Kinugawa, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 15/626,505

(22) Filed: Jun. 19, 2017

(65) Prior Publication Data

US 2017/0370073 A1 Dec. 28, 2017

(30) Foreign Application Priority Data

Jun. 24, 2016 (JP) ..... 2016-125815

(51) Int. Cl.

| | |
|---|---|
| ***E02F 9/22*** | (2006.01) |
| ***E02F 9/20*** | (2006.01) |
| *E02F 3/34* | (2006.01) |
| *E02F 3/42* | (2006.01) |
| *E02F 9/16* | (2006.01) |

(52) U.S. Cl.

CPC ..... *E02F 9/2246* (2013.01); *E02F 9/2062* (2013.01); *E02F 3/3414* (2013.01); *E02F 3/422* (2013.01); *E02F 9/166* (2013.01); *E02F 9/207* (2013.01); *E02F 9/2066* (2013.01)

(58) Field of Classification Search

CPC ..... E02F 9/2246; E02F 9/2062; E02F 9/207; E02F 9/2066; E02F 3/3414; E02F 9/166; E02F 3/422

See application file for complete search history.

(56) References Cited

U.S. PATENT DOCUMENTS

2014/0350800 A1* 11/2014 Yoshida ..... F02D 29/02 701/50

FOREIGN PATENT DOCUMENTS

| | | |
|---|---|---|
| JP | 2000-289977 | 10/2000 |
| WO | 2013-111613 | 8/2013 |

OTHER PUBLICATIONS

Japanese Office Action (with English translation) issued in JP 2016-125815 dated Mar. 20, 2019.

* cited by examiner

*Primary Examiner* — Nadeem Odeh
*Assistant Examiner* — Michael V Kerrigan
(74) *Attorney, Agent, or Firm* — Greenblum & Bernstein, P.L.C.

(57) ABSTRACT

A work machine includes a prime mover, a hydraulic pump to be operated by the prime mover to output an operation fluid, a hydraulic device to be operated by the operation fluid, a measurement sensor to measure a first temperature and a second temperature, the first temperature being a temperature of the operation fluid at starting of the prime mover, the second temperature being a temperature of the operation fluid after the starting of the prime mover, and a controller including a determiner to determine an upper limit revolution speed based on the first temperature, the upper limit revolution speed being an upper limit of a revolution speed of the prime mover, and a changer to change the upper limit revolution speed based on the second temperature.

12 Claims, 12 Drawing Sheets

FIG. 8

| | Start time [s] | Fluid temperature [°C] | Engine upper lim. rev. speed [rpm] |
|---|---|---|---|
| 1st. upper lim. setting info. | 0 | −20 | 1000 |
| 2nd. upper lim. setting info. | 40 | −19 | 1250 |
| | 60 | −18 | 1500 |
| | 70 | −17 | 1750 |
| | 75 | −16 | 2000 |
| | 80 | −15 | 2250 |
| | 85 | −14 | 2500 |

FIG. 9

| | Start time [s] | Fluid temperature [°C] | Engine upper lim. rev. speed [rpm] | | |
|---|---|---|---|---|---|
| | | | Error ±0°C | Error +2°C | Error −2°C |
| 1st. upper lim. setting info. | 0 | −20 | 1000 | 1500 | 1000 |
| 2nd. upper lim. setting info. | 40 | −19 | 1250 | 1750 | 1000 |
| | 60 | −18 | 1500 | 2000 | 1000 |
| | 70 | −17 | 1750 | 2250 | 1250 |
| | 75 | −16 | 2000 | 2500 | 1500 |
| | 80 | −15 | 2250 | 2500 | 1750 |
| | 85 | −14 | 2500 | 2500 | 2000 |

FIG. 10

| Engine start temperature | | | −24°C | −22°C | −20°C | −18°C | −16°C | −14°C |
|---|---|---|---|---|---|---|---|---|
| Temperature changing amount | | | 8°C | 7°C | 6°C | 5°C | 4°C | 3°C |
| Changing amount | | | 188rpm | 214rpm | 250rpm | 301rpm | 373rpm | 500rpm |
| Engine upper lim. rev. speed [rpm] | 1st. upper lim. setting info. | 1000 | −24.0 | −22.0 | −20.0 | −18.0 | −16.0 | −14.0 |
| | 2nd. upper lim. setting info. | 1250 | −22.7 | −20.8 | −19.0 | −17.2 | −15.3 | −13.5 |
| | | 1500 | −21.3 | −19.7 | −18.0 | −16.3 | −14.7 | −13.0 |
| | | 1750 | −20.0 | −18.5 | −17.0 | −15.5 | −14.0 | −12.5 |
| | | 2000 | −18.7 | −17.3 | −16.0 | −14.7 | −13.3 | −12.0 |
| | | 2250 | −17.4 | −16.2 | −15.0 | −13.9 | −12.7 | −11.5 |
| | | 2500 | −16.0 | −15.0 | −14.0 | −13.0 | −12.0 | −11.0 |

FIG. 11

| | Start time [s] | Fluid temperature [°C] | Engine upper lim. rev. speed [rpm] | | |
|---|---|---|---|---|---|
| | | | Error ±0°C | Error +2°C | Error −2°C |
| 1st. upper lim. setting info. | 0 | −20 | 1000 | 1000 | 1000 |
| 2nd. upper lim. setting info. | 40 | −19 | 1250 | 1301 | 1214 |
| | 60 | −18 | 1500 | 1603 | 1427 |
| | 70 | −17 | 1750 | 1904 | 1641 |
| | 75 | −16 | 2000 | 2205 | 1855 |
| | 80 | −15 | 2250 | 2506 | 2068 |
| | 85 | −14 | 2500 | 2807 | 2282 |

FIG. 12

| At engine start (1st fluid temp.[°C]) | At engine start (2nd fluid temp.[°C]) | Difference between fluid temps.[°C] |
|---|---|---|
| −10 | 5 | 15 |
| −15 | 0 | 15 |
| −20 | −5 | 15 |
| −25 | −10 | 15 |
| −30 | −15 | 15 |

FIG. 13

| At engine start (1st fluid temp.[℃]) | At engine start (2nd fluid temp.[℃]) | Difference between fluid temps.[℃] |
|---|---|---|
| −10 | 5 | 15 |
| −15 | 2 | 17 |
| −20 | −1 | 19 |
| −25 | −4 | 21 |
| −30 | −7 | 23 |

WORK MACHINE

CROSS-REFERENCE TO RELATED APPLICATIONS

The present application claims priority under 35 U.S.C. § 119 to Japanese Patent Application No. 2016-125815, filed Jun. 24, 2016. The contents of this application are incorporated herein by reference in their entirety.

BACKGROUND OF THE INVENTION

Field of the Invention

The present invention relates to a hydraulic system for a work machine.

Discussion of the Background

Japanese patent application publication No. 2000-289977 discloses a conventional technique for reducing a revolution speed of an engine in a case where a temperature of an operation fluid is low, the operation fluid being used for activating a hydraulic device.

In a case where the revolution speed of the engine is controlled by an operation of an acceleration member, an engine acceleration device disclosed in Japanese patent application publication No. 2000-1289977 restricts the revolution speed of the engine when the temperature of the operation fluid is equal to or less than a predetermined temperature (a restriction temperature).

SUMMARY OF THE INVENTION

A work machine includes a prime mover, a hydraulic pump to be operated by the prime mover to output an operation fluid, a hydraulic device to be operated by the operation fluid, a measurement sensor to measure a first temperature and a second temperature, the first temperature being a temperature of the operation fluid at starting of the prime mover, the second temperature being a temperature of the operation fluid after the starting of the prime mover, and a controller including a determiner to determine an upper limit revolution speed based on the first temperature, the upper limit revolution speed being an upper limit of a revolution speed of the prime mover, and a changer to change the upper limit revolution speed based on the second temperature.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 8 is a view illustrating a table of a relation between a start time, a fluid temperature, and an upper limitation value of the actual engine revolution speed according to the first embodiment.

FIG. 9 is a view illustrating a table showing the upper limitation revolution speeds bases on errors of a temperature sensor according to the first embodiment;

FIG. 10 is a view illustrating a table sowing a first upper limit setting information and a second upper limit setting information according to a second embodiment of the present invention;

FIG. 11 is a view illustrating a table showing summary of FIG. 10 setting the error of the temperature sensor to the similar errors of FIG. 9 according to the second embodiment;

FIG. 12 is a view illustrating a table showing a relation between a first temperature and a second temperature according to a third embodiment of the present invention; and FIG. 13 is a view illustrating a table showing a difference between the first temperature and the second temperature according to the third embodiment, the difference being not fixed but variable.

DESCRIPTION OF THE EMBODIMENTS

Figure 1:
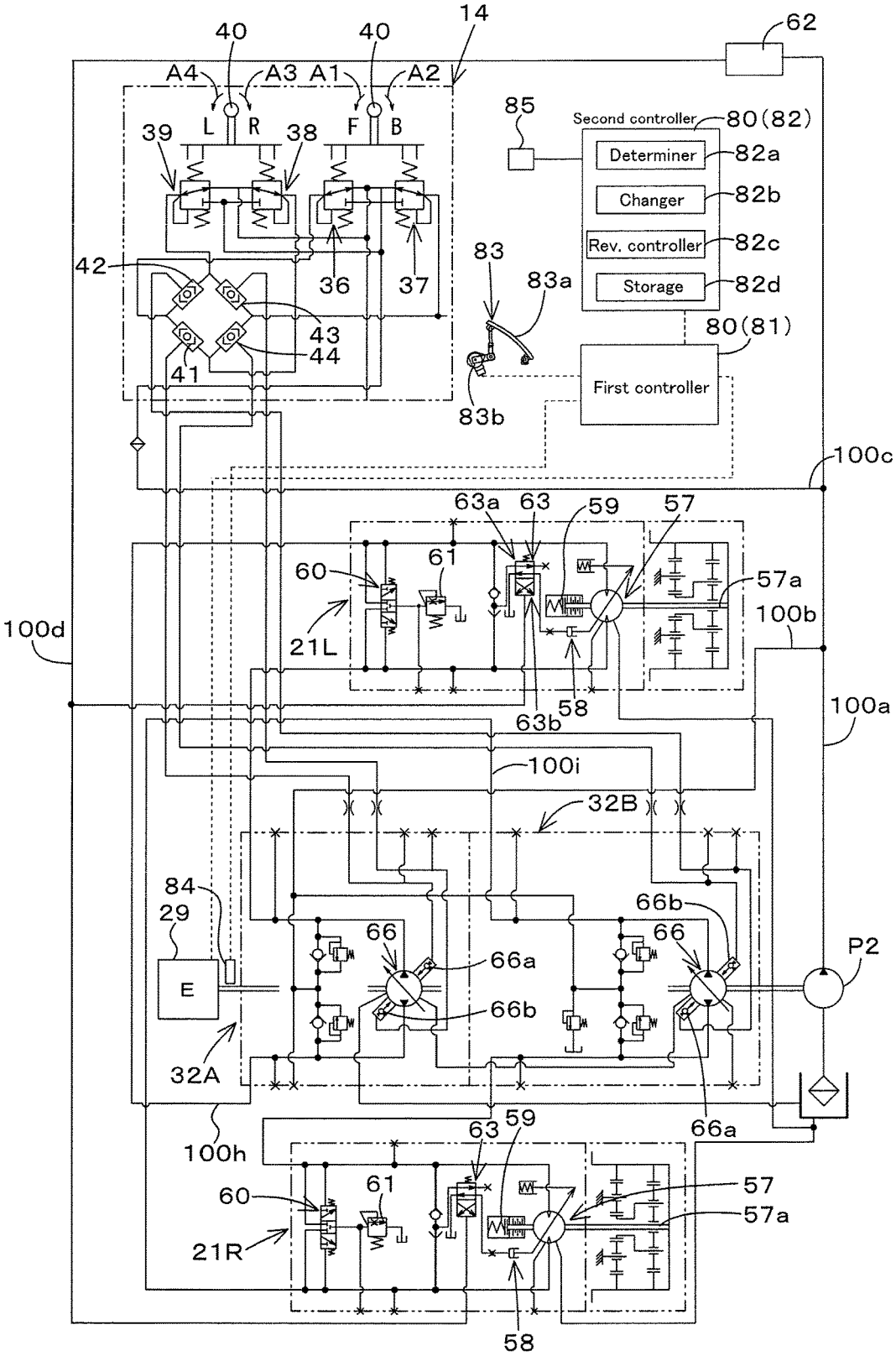
FIG. 1 is a view illustrating a hydraulic system (a hydraulic circuit) for travel of a work machine according to a first embodiment of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

Referring to drawings, embodiments of the present invention will be described below.

(First Embodiment)

Firstly, a whole configuration of a work machine according to a first embodiment of the present invention will be explained below.

Figure 6:
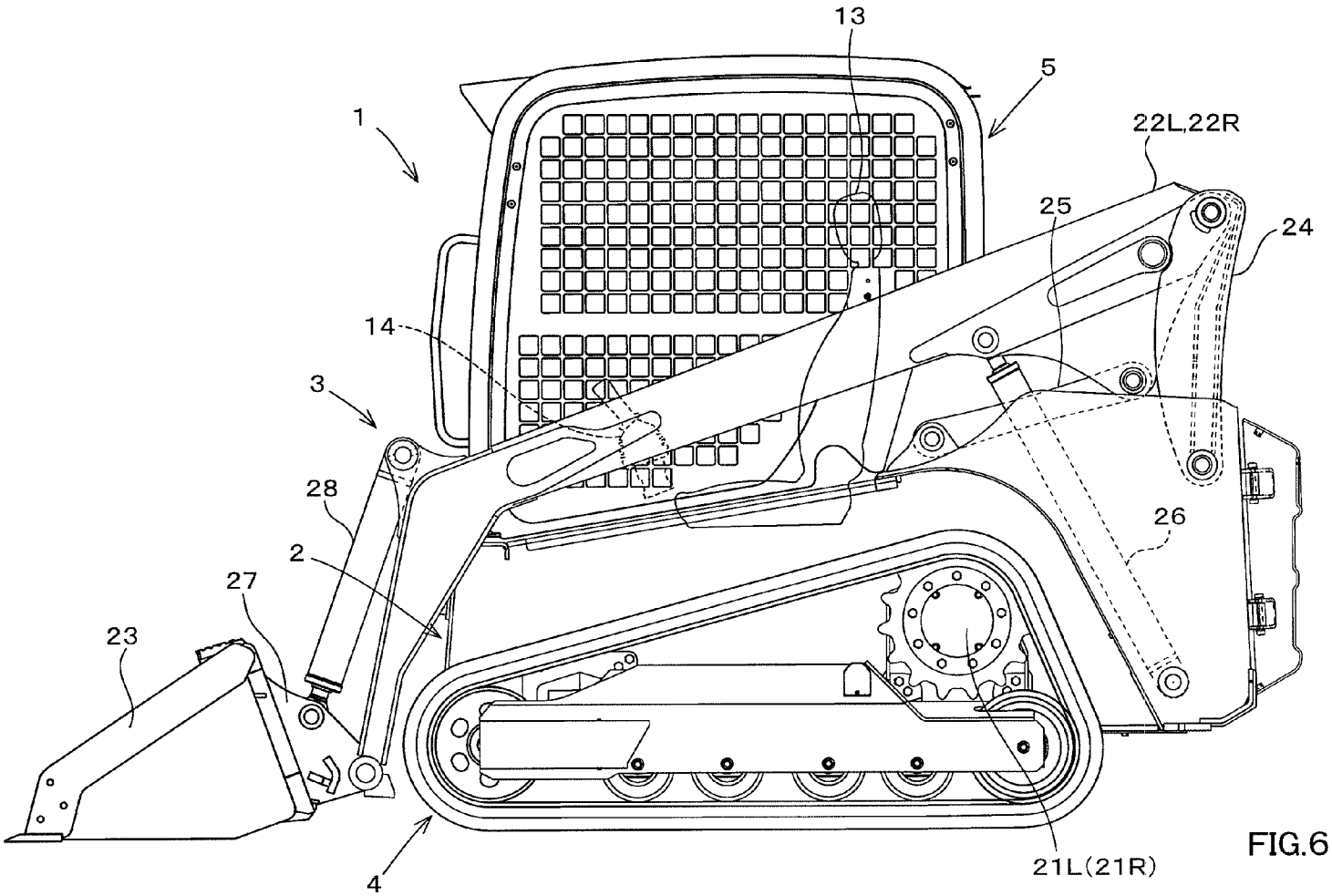
FIG. 6 is a side view illustrating a track loader exemplified as the work machine according to the embodiments.
Figure 7:
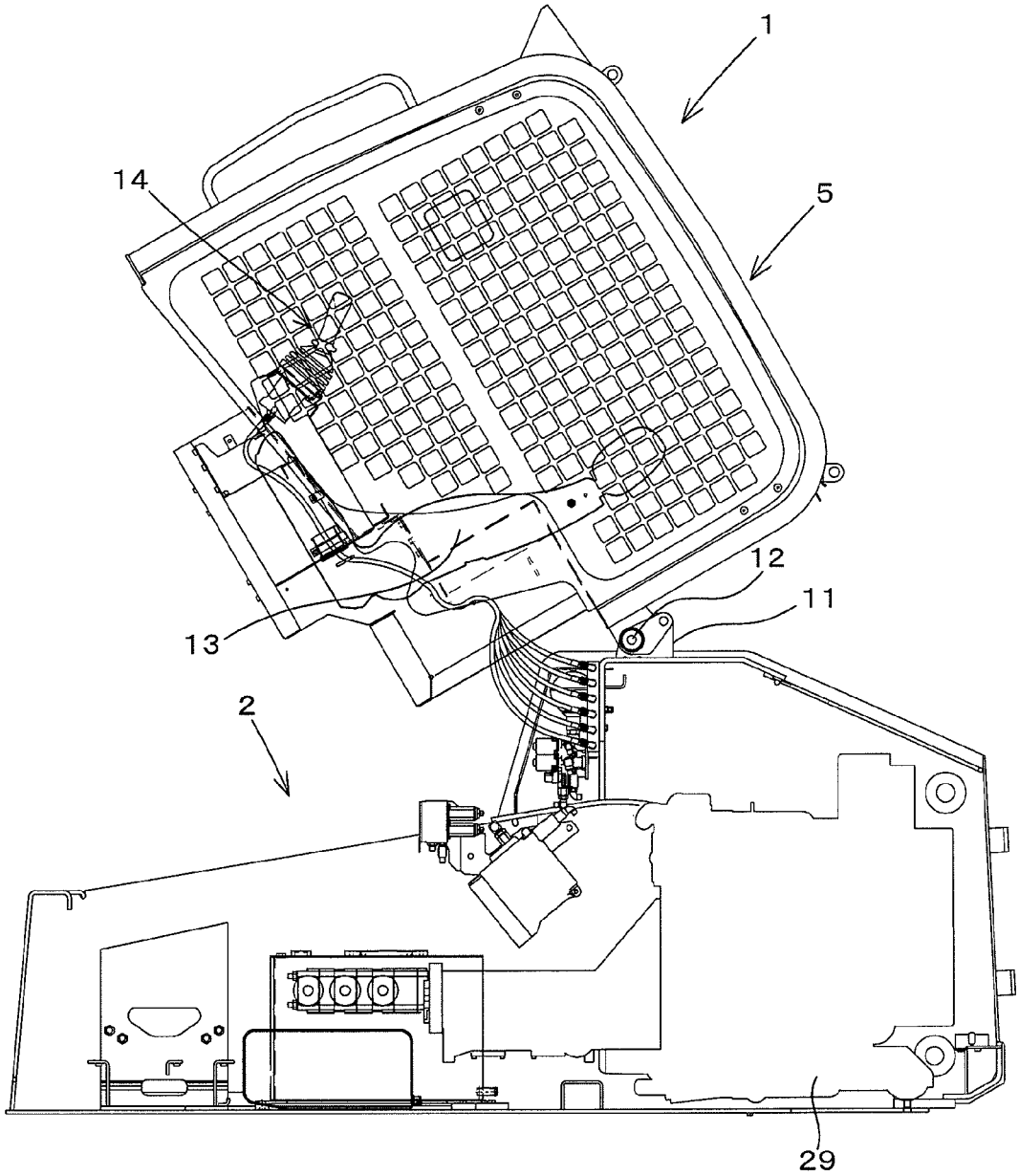
FIG. 7 is a side view illustrating a part of the track loader lifting up a cabin according to the embodiments.

As shown in FIG. 6 and FIG. 7, the work machine 1 according to the embodiment includes a machine frame 2, a work device 3 attached to the machine frame 2, and a travel device 4 supporting the machine frame 2.

Meanwhile, a track loader is exemplified as the work machine 1 in FIG. 6 and FIG. 7. However, the work machine 1 according to the embodiment is not limited to the track loader, and may be, for example, a tractor, a skid steer loader, a compact track loader, a backhoe, and the like.

Hereinafter, in explanations of all the embodiments of the present invention, a forward direction (a direction toward a left side in FIG. 6) corresponds to a front side of an operator seating on an operator seat 13 of the work machine 1, a backward direction (a direction toward a right side in FIG. 6) corresponds to a back side of the operator, a leftward direction (a direction toward a front side from the back of FIG. 6) corresponds to a left side of the operator, and a rightward direction (a direction toward a back side from the front of FIG. 6) corresponds to a right side of the operator. In the explanations, a machine width direction corresponds to a horizontal direction perpendicular to the forward direction and the backward direction. A machine outward direction corresponds to a direction from a center portion of the machine frame 2 toward the right and corresponds to a direction from the center portion of the machine frame 2 toward the left.

In other words, the machine outward direction is equivalent to the machine width direction and is a direction stepping away from (separating from) a center of the machine width direction. A direction opposite to the machine outward direction is referred to as a machine inward direction. In other words, the machine inward direction is equivalent to the machine width direction and is a direction stepping up to (being closed to) the center of the machine width direction.

A cabin 5 is mounted on an upper front portion of the machine frame 2. A rear portion of the cabin 5 is supported swingably about a support shaft 12 by a support bracket 11 of the machine frame 2. The front portion of the cabin 5 is configured to be mounted on a front portion of the machine frame 2.

The operator seat 13 is arranged inside the cabin 5. A traveling operation device 14 is arranged in one side (for example, on the left side) of the operator seat 13, the traveling operation device 14 being configured to operate the travel device 4.

The travel device 4 is constituted of a crawler-type travel device. The travel device 4 is disposed under the left side of the machine frame 2. Another travel device 4 is disposed under the right side of the machine frame 2. The travel device 4 includes a first travel portion 21L and a second travel portion 21R each configured to be activated by the hydraulic driving, and thereby is capable of traveling due to the first travel portion 21L and the second travel portion 21R.

The work device 3 includes a pair of booms 10 and a bucket 23 (a work tool) attached to the tip ends of the booms. The pair of booms 10 includes a boom L and a boom R. The boom 22L is arranged to the left of the machine frame 2.

The boom 22R is arranged to the right of the machine frame 2. The boom 22L and the boom 22R are connected to each other by a connection member. The boom 22L and the boom 22R are supported by a first lift link 24 and a second lift link 25.

A lift cylinder 26 is disposed between a lower rear portion of the machine frame 2 and the base portions of the booms 22L and 22R, the lift cylinder 26 being constituted of a double-action hydraulic cylinder. The lift cylinder 26 is stretched and shortened to move the boom 22L and the boom 22R upward and downward.

Attachment brackets 27 are pivotally supported by each of the tip end portions of the boom 22L and the boom 22R, and are capable of turning about the lateral shaft. A back surface of the bucket 23 is attached to the attachment brackets 27, one of the attachment brackets 27 being arranged to the left, the other one of the attachment brackets being arranged to the right.

A tilt cylinder 28 is disposed between the attachment brackets and the intermediate portions of the tip end sides of the booms 22L and 22R, the tilt cylinder 28 being constituted of a double-action hydraulic cylinder. The tilt cylinder 28 is stretched and shortened to swing the bucket 23 (make the bucket 23 perform the shoveling movement and the dumping movement).

The bucket 23 is attachable to and detachable from the attachment brackets 27. The bucket 23 is detached from the attachment brackets 27 to be replaced by another type of attachment (a work tool to be hydraulically activated having a hydraulic actuator described below), thereby providing a configuration to perform other types of works other than the excavation (or other excavating works).

A prime mover 29 is disposed on a rear portion of the bottom wall of the machine frame 2. A fuel oil tank (a fuel tank) and an operation fluid tank are disposed on a front portion of the bottom wall of the machine frame 2. The prime mover 29 is, for example, a diesel engine.

Meanwhile, the prime mover 29 may be an electric motor, and may be combination of the diesel engine and the electric motor. The diesel engine may be simply referred to as an engine.

The hydraulic system for the work machine according to the embodiment will be explained next.

Figure 2:
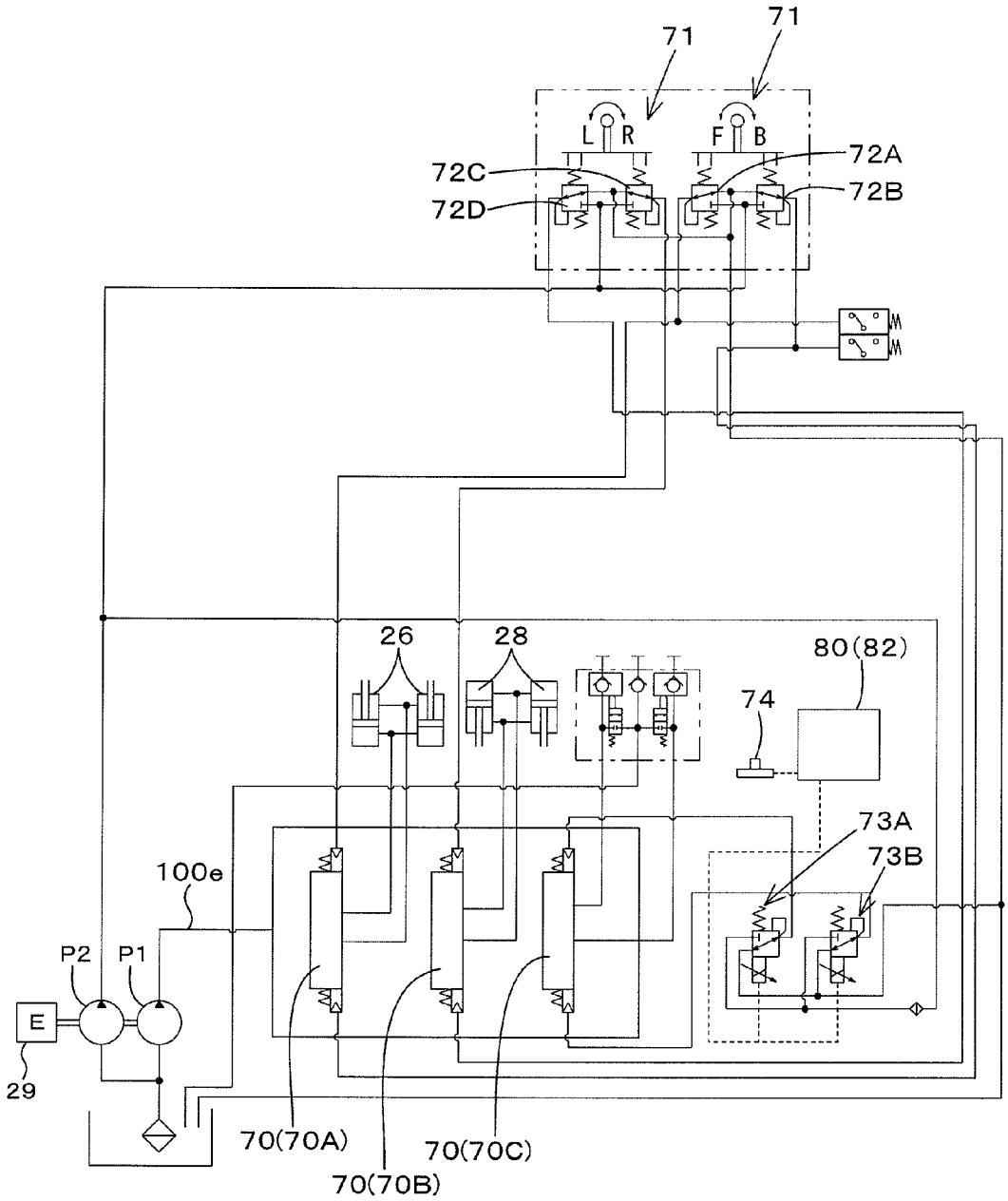
FIG. 2 is a view illustrating a hydraulic system (a hydraulic circuit) for operation of the work machine according to the first embodiment.

FIG. 1 is a whole view illustrating a hydraulic system for travel. FIG. 2 is a whole view illustrating a hydraulic system for work.

The hydraulic system for travel will be explained first.

As shown in FIG. 1 and FIG. 2, the hydraulic system (a hydraulic circuit) includes a first hydraulic pump P1 and a second hydraulic pump P2. Each of the first hydraulic pump P1 and the second hydraulic pump P2 is a hydraulic pump configured to be driven by a motive power of the prime mover 29 and thus to output the operation fluid. Each of the first hydraulic pump P1 and the second hydraulic pump P2 is constituted of a constant-displacement gear pump.

The first hydraulic pump P1 (a main pump) is used for driving a hydraulic actuator of the attachment attached to the lift cylinder 26, the tilt cylinder 28, or the boom 22. The second hydraulic pump P2 (a pilot pump, a charge pump) is used mainly for supplying a control signal (a pilot pressure).

For convenience of the explanation, the operation fluid outputted from the second hydraulic pump P2 will be referred to as a pilot fluid, and the operation fluid for the control signal outputted from the second hydraulic pump P2 also will be referred to as the pilot fluid. And, a pressure of the pilot fluid will be referred to as a pilot pressure.

As shown in FIG. 1, an output fluid tube (an output fluid path) 100*a* is connected to the second hydraulic pump P2. A first supply-drain fluid tube (a first supply-drain fluid path) 100*b* and a second supply-drain fluid tube (a second supply-drain fluid path) 100*c* are connected to the output fluid tube 100*a*. A first drive circuit 32A and a second drive circuit 32B are connected to the first supply-drain fluid tube 100*b*. The traveling operation device 14 is connected to the second supply-drain fluid tube 100*c*.

The first drive circuit 32A is a circuit configured to drive the first travel portion 21L arranged to the left. The second drive circuit 32B is a circuit configured to drive the second travel portion 21R arranged to the right.

The first drive circuit 32A includes an HST pump (a travel hydraulic pump) 66. The HST pump 66 is connected to the HST motors (the travel motors) 57 of the first travel portions 21L and 21R by a pair of the speed-changing fluid tubes (the speed-changing fluid paths) 100*h* and 100*i*.

Meanwhile, the second drive circuit 32B has a configuration similar to the configuration of the first drive circuit 32A. Explanation of the second drive circuit 32B will be omitted. The HST pump (the travel hydraulic pump) 66 and the HST motors 57 are each constituted of the hydraulic devices.

The HST pump 66 is constituted of a variable-displacement axial pump having a swash plate that is configured to be driven by a motive power of the prime mover 29, that is, constituted of a hydraulic pump (the variable-displacement axial pump having a swash plate) configured to be driven by the pilot pressure, the pilot pressure changing an angle of the swash plate. In particular, the HST pump 66 includes a forward-movement pressure-receiving portion 66*a* (a pressure-receiving portion 66*a*) and a backward-movement pressure-receiving portion 66*b* (a pressure-receiving portion 66*b*). The pilot pressure is applied to the forward-movement pressure-receiving portion 66*a* and the backward-movement pressure-receiving portion 66*b*.

An angle of the swash plate is changed by the pilot pressure applied to the pressure-receiving portion 66*a* and the pressure-receiving portion 66*b*. When the angle of the swash plate is changed, the changing changes the outputs (output amounts of the operation fluid) of the HST pump 66 and changes the directions of the outputs of the operation fluid. In this manner, the first travel portion 21L and the second travel portion 21R change the revolution powers.

The first travel portion 21L includes a travel motor 57, a swash-plate switch cylinder 58, a brake mechanism 59, a flushing valve 60, and a flushing relief valve 61. The swash-plate switch cylinder 58, the brake mechanism 59, the flushing valve 60, and the flushing relief valve 61 are each constituted of the hydraulic devices.

The travel motor 57 is activated by the pilot fluid (the operation fluid). The travel motor 57 is constituted of, for example, a variable-displacement axial motor having a swash plate, the variable-displacement axial motor having two speeds to be switched to a high speed and to a low speed. The swash-plate switch cylinder 58 is connected to the swash plate of the travel motor 57, the swash-plate switch cylinder 58 being configured to be stretched and shortened.

The swash-plate switch cylinder 58 is stretched and shortened to change the angle of the swash plate of the travel motor 57. When the angle of the swash plate of the travel motor 57 is changed, the travel motor 57 changes the speed to the first speed or the second speed.

The first hydraulic switch valve 63 is constituted of a two-position switch valve having a spool, the spool being configured to move between a first position 63*a* and a second position 63*b* in accordance with a pressure of the pilot fluid (the pilot pressure). The spool of the first hydraulic switch valve 63 moves to the second position 63*b* when the pilot pressure reaches a predetermined pressure, thereby changing the operational state.

In addition, the spool of the first hydraulic switch valve 63 is returned to the first position 63*a* by a spring when the pilot pressure is less than the predetermined pressure, thereby changing the operational state. In the operational state where the spool of the first hydraulic switch valve 63 is moved to the first position 63*a*, the pilot fluid is released from the swash-plate switch cylinder 58 to be shortened, and thereby the travel motor 57 is switched to the first speed.

In the operational state where the spool of the first hydraulic switch valve 63 is moved to the second position 63*b*, the pilot fluid is supplied to the swash-plate switch cylinder 58 to be stretched, and thereby the travel motor 57 is switched to the second speed.

The first hydraulic switch valve 63 is switched by the second hydraulic switch valve 62. The first hydraulic switch valve 63 is connected to the second hydraulic switch valve 62 by a third supply-drain fluid tube (a third supply-drain fluid path) 100*d*. The second hydraulic switch valve 62 is constituted of a two-position switch valve having a spool, the spool being configured to move between a first position and a second position in accordance with a pressure of the pilot fluid (the pilot pressure).

When the second hydraulic switch valve 62 is at the first position, the first hydraulic switch valve 63 is at the first position 63*a*. When the second hydraulic switch valve 62 is at the second position, the first hydraulic switch valve 63 is at the second position 63*a*. The second hydraulic switch valve 62 is switched by an electric signal, the pilot pressure, a mechanical operation, and the like. In this manner, the travel motor is switched to the first speed and to the second speed by switching the second hydraulic switch valve 62 to the first position and to the second position.

The HST pump 66 and the travel motor 57 are operated by the traveling operation device 14. The traveling operation device 14 includes a plurality of remote control valves, a travel lever 40, a first shuttle valve 41, a second shuttle valve 42, a third shuttle valve 43, and a fourth shuttle valve 44.

The plurality of remote control valves include a remote control valve 36, a remote control valve 37, a remote control valve 38, and a remote control valve 39. The remote control valve 36, the remote control valve 37, the remote control valve 38, and the remote control valve 39 are operated singularly by the travel lever 40. The remote control valves 36, 37, 38, and 39 change the pressures of the operation fluids in accordance with the operation of the travel lever 40 (an operation member).

The travel lever 40 is configured to be tilted from a neutral position forward, backward, toward the width direction perpendicular to the forward direction and the backward direction, and toward the diagonal directions. When the travel lever 40 is tilted, the remote control valves 36, 37, 38, and 39 of the traveling operation device 14 are operated. Then, secondary ports of the remote control valves 36, 37, 38, and 39 output the pilot pressures proportional to an operation amount (an operation extent) of the travel lever 40 from the neutral position.

When the travel lever 40 is tilted forward (toward a direction indicated by an arrowed line A1 in FIG. 1), the remote control valve 36 is operated to output the pilot pressure from the remote control valve 36. The pilot pressure is applied to the forward-movement pressure-receiving portion 66*a* of the first drive circuit 32A from the first shuttle valve 41 through a fluid tube, and is applied to the forward-movement pressure-receiving portion 66*a* of the second drive circuit 32B from the second shuttle valve 42 through a fluid tube.

In this manner, the output shafts 57*a* of the first travel portion 21L and the second travel portion 21R revolve forward (a forward revolution) at a speed proportional to a tilting amount (a tilting extent) of the travel lever 40, and thus the track loader 1 moves straight forward.

When the travel lever 40 is tilted backward (toward a direction indicated by an arrowed line A2 in FIG. 1), the remote control valve 37 is operated to output the pilot pressure from the remote control valve 37. The pilot pressure is applied to the backward-movement pressure-receiving portion 66*b* of the first drive circuit 32A from the third shuttle valve 43 through a fluid tube, and is applied to the backward-movement pressure-receiving portion 66*b* of the second drive circuit 32B from the fourth shuttle valve 44 through a fluid tube.

In this manner, the output shafts 57*a* of the first travel portion 21L and the second travel portion 21R revolve backward (a backward revolution) at a speed proportional to a tilting amount (a tilting extent) of the travel lever 40, and thus the track loader 1 moves straight backward.

When the travel lever 40 is tilted rightward (toward a direction indicated by an arrowed line A3 in FIG. 1), the remote control valve 38 is operated to output the pilot pressure from the remote control valve 38. The pilot pressure is applied to the forward-movement pressure-receiving portion 66*a* of the first drive circuit 32A from the first shuttle valve 41 through a fluid tube, and is applied to the backward-movement pressure-receiving portion 66*b* of the second drive circuit 32B from the fourth shuttle valve 44 through a fluid tube.

In this manner, the output shaft 57*a* of the first travel portion 21L revolves forward and the output shaft 57*a* of the second travel portion 21R revolves backward, and thus the track loader 1 turns rightward.

When the travel lever 40 is tilted leftward (toward a direction indicated by an arrowed line A4 in FIG. 1), the remote control valve 39 is operated to output the pilot pressure from the remote control valve 39. The pilot pressure is applied to the forward-movement pressure-receiving portion 66*a* of the second drive circuit 32B from the second shuttle valve 42 through a fluid tube, and is applied to the backward-movement pressure-receiving portion 66*b* of the first drive circuit 32A from the third shuttle valve 43 through a fluid tube.

In this manner, the output shaft 57*a* of the second travel portion 21R revolves forward and the output shaft 57*a* of the first travel portion 21L revolves backward, and thus the track loader 1 turns leftward.

When the travel lever 40 is tilted toward the diagonal direction, the revolution directions and the revolution speeds of the output shafts 57*a* are determined based on a differential pressure between the pilot pressures applied to the forward-movement pressure-receiving portion 66*a* and the backward-movement pressure-receiving portion 66*b* of the first drive circuit 32A and the second drive circuit 32B, the output shafts 57*a* being included in the first travel portion 21L and the second travel portion 21R, and thus the track loader 1 turns rightward or leftward traveling forward or backward.

That is, when the travel lever 40 is tilted diagonally forward and leftward, the track loader 1 turns leftward traveling forward at a speed corresponding to the tilted angle of the travel lever 40. When the travel lever 40 is tilted diagonally forward and rightward, the track loader 1 turns rightward traveling forward at a speed corresponding to the tilted angle of the travel lever 40. When the travel lever 40 is tilted diagonally backward and leftward, the track loader 1 turns leftward traveling backward at a speed corresponding to the tilted angle of the travel lever 40. And, when the travel lever 40 is tilted diagonally backward and rightward, the track loader 1 turns rightward traveling backward at a speed corresponding to the tilted angle of the travel lever 40.

The hydraulic system for operation will be explained next.

As shown in FIG. 2, an output fluid tube (an output fluid path) 100*e* is connected to the first hydraulic pump P1. A plurality of control valves 70 are connected to the output fluid tube 100*e*. The plurality of control valves 70 includes a boom control valve 70A, a bucket control valve 70B, and an auxiliary control valve 70C. The boom control valve 70A is a valve configured to control the lift cylinder 26. The bucket control valve 70B is a valve configured to control the tilt cylinder 28. The auxiliary control valve 70C is a valve configured to control a hydraulic actuator of the auxiliary attachment.

In the hydraulic system for operation, the lift cylinder 26, the tilt cylinder 28, the hydraulic actuator of the auxiliary attachment, and the like are hydraulic devices.

The boom 22 and the bucket 23 are operated by an operation member 71. The operation member 71 is arranged around the operator seat 13. The operation member 71 is configured to be tilted from a neutral position forward, backward, toward the width direction perpendicular to the forward direction and the backward direction, and toward the diagonal directions. When the operation member 71 is tilted, the remote control valves 72A, 72B, 72C, and 72D arranged under the operation member 71.

When the operation member 71 is tilted forward, the remote control valve 72A is operated to output the pilot pressure from the remote control valve 72A. The pilot pressure is applied to the pressure-receiving portion of the boom control valve 70A, then the operation fluid flowing into the boom control valve 70A is supplied to a rod side of the lift cylinder 26, and thus the boom 22 is moved downward.

When the operation member 71 is tilted backward, the remote control valve 72B is operated to output the pilot pressure from the remote control valve 72B. The pilot pressure is applied to the pressure-receiving portion of the boom control valve 70A, then the operation fluid flowing into the boom control valve 70A is supplied to a bottom side of the lift cylinder 26, and thus the boom 22 is moved upward.

That is, the boom control valve 70A is configured to control a flow rate of the operation fluid flowing to the lift cylinder 26 in accordance with a pressure of the operation fluid set by the operation of the operation member 71 (the pilot pressure set by the remote control valve 72A, the pilot pressure set by the remote control valve 72B).

When the operation member 71 is tilted rightward, the remote control valve 72C is operated to apply the pilot pressure to the pressure-receiving portion of the bucket control valve 70B. As the result, the bucket control valve 70B is activated to a direction to stretch the tilt cylinder 28, and the bucket 23 performs the dumping movement at a speed proportional to a tilting angle of the operation member 71.

When the operation member 71 is tilted leftward, the remote control valve 72D is operated to apply the pilot pressure to the pressure-receiving portion of the bucket control valve 70B. As the result, the bucket control valve 70B is activated to a direction to shorten the tilt cylinder 28, and the bucket 23 performs the shoveling movement at a speed proportional to a tilting angle of the operation member 71.

That is, the bucket control valve 70B is capable of controlling the flow rate of the operation fluid flowing to the tilt cylinder 28 in accordance with a pressure of the operation fluid set by the operation of the operation member 71 (the pilot pressure set by the remote control valve 72C, the pilot pressure set by the remote control valve 72D).

That is, the remote control valves 72A, 72B, 72C, and 72D change the pressure of the operation fluid in accordance with the operation of the operation member 71, and supply the changed operation fluid to the boom control valve 70A and the bucket control valve 70B.

The auxiliary control valve 70C is operated by a first electromagnetic valve 73A and a second electromagnetic valve 73B. When the first electromagnetic valve 73A is opened, the pilot fluid is applied to one of the pressure-receiving portions of the auxiliary control valve 70C. In addition, when the first electromagnetic valve 73B is opened, the pilot fluid is applied to the other one of the pressure-receiving portions of the auxiliary control valve 70C.

In this manner, when the pilot fluid is applied to one of or the other one of the pressure-receiving portions of the auxiliary control valve 70C, the auxiliary control valve 70C is switched, and thus the auxiliary actuator of the auxiliary attachment is activated by the operation fluid supplied from the auxiliary control valve 70C.

As shown in FIG. 2, the track loader (the work machine) 1 includes a plurality of control devices (controllers) 80 configured to control the work machine 1. The control devices 80 include a first control device 81 and a second control device 82. The second control device 82 is shown in FIG. 1 and FIG. 2. The second control valve 82 shown in FIG. 1 is identical to the second control valve 82 shown in FIG. 2.

The first control device 81 is constituted of a CPC and the like, and controls the prime mover 29. In the case where the prime mover 29 is the engine, the first control device 81 is an engine control device (an engine controller). For convenience of the explanation, the prime mover 29 is the engine in the following explanation.

An ordering member 83 is connected to the first control device 81. The ordering member 83 is configured to order a target revolution speed of engine (referred to as a target engine revolution speed). The ordering member 83 includes an ordering tool 83*a* and a sensor 83*b*. The sensor 83*b* detects an operation amount (an operation extent) of the ordering tool 83*a*.

The ordering tool 83*a* is constituted of an acceleration lever supported swingably, an acceleration pedal supported swingably, a dial supported being capable of turning, and the like. The operation amount (operation extent) detected by the sensor 83*b* is inputted to the first control device 81. The operation amount (operation extent) detected by the sensor 83*b* is the target revolution speed of engine.

In addition, a sensor (measurement sensor) 84 is connected to the first control device 81. The sensor 84 is configured to detect an actual engine revolution speed (referred to as an actual revolution speed of the engine).

The first control device 81 provides a general engine control, and outputs the control signals representing a fuel injection amount, an injection timing, and a fuel injection rate to an injector, for example. In addition, the first control device 81 outputs the control signal representing the fuel injection pressure to a supply pump and to the common rail. That is, the first control device 81 controls the injector, the supply pump, and the common rail such that the actual revolution speed of the engine satisfies the target revolution speed of the engine.

The second control device (the second controller) 82 is constituted of a CPC and the like, and controls the hydraulic system. The second control device 82 controls the first electromagnetic valve 73A and the second electromagnetic valve 73B, for example.

As shown in FIG. 2, a switch 74 is connected to the second control device 82, the switch 74 being arranged around the operator seat 13. The switch 74 is constituted of a seesaw switch configured to be swung, a slide switch configured to be slid, or a push switch configured to be pushed. An operation of the switch 74 is inputted to the second control device 82.

The operation of the switch 74 opens and closes the first electromagnetic valve 73A or the second electromagnetic valve 73B. In this manner, the auxiliary actuator is operated under the control of the second control device 82. Meanwhile, the second control device 82 is capable of obtaining information relating to the engine 29 (hereinafter referred to as engine information).

For example, the second control device 82 obtains a signal indicating ON or OFF of an ignition switch, a signal indicating an operational state of a starter (a signal indicating the starter activation, a signal indication the starter deactivation), and the actual engine revolution speed. In addition, the first control device 81 may obtain the engine information.

Meanwhile, the work machine 1 includes a measurement device 85 configured to measure a temperature of the operation fluid. The measurement device 85 is, for example, a temperature sensor configured to measure (detect) a temperature of the operation fluid stored in the operation fluid tank and to measure a temperature of the operation fluid and the like outputted from the first hydraulic pump P1. The measurement device 85 may be constituted of any one of devices configured to measure a temperature of the operation fluid. The temperature sensor 85 is connected to the second control device 82.

The second control device 82 includes a determination portion (a determiner) 82*a*, a change portion (a changer) 82*b*, a revolution control portion (a revolution controller) 82*c*, and a storage portion (a storage) 82*d*. The determination portion 82*a*, the change portion 82*b*, and the revolution control portion 82*c* are each constituted of the electric or electronic components, the computer programs stored in the second control device 82, and the like. The storage portion 82*d* is constituted of a nonvolatile memory or the like.

The determination portion 82*a* restricts an upper limitation revolution speed of the engine 29 on the basis of a temperature of the operation fluid (hereinafter referred to as a first temperature) at the starting of the engine 29, the upper limitation speed being an upper limitation of a revolution speed of the engine (the target engine revolution speed or the actual engine revolution speed).

The starting of the engine corresponds to "a timing just before a starter is activated under a state where an ignition switch is ON (hereinafter referred to as a first activation timing)", to "a timing just after a starter is activated under the state where an ignition switch is ON (hereinafter referred to as a second activation timing)", to "a timing when a clutch of the starter is detached [the starter detachment] (hereinafter referred to as a third activation timing)", to "a timing just after the actual engine revolution speed exceeds 500 rpm for a predetermined time after the ignition is turned ON [a timing when a condition to cause the engine stall is eliminated] (hereinafter referred to as a fourth activation timing)", and to "a timing when the actual engine revolution speed reaches an idling revolution speed (hereinafter referred to as a fifth activation timing)".

In the embodiment, the fourth activation timing is employed as the starting of the engine from among the first activation timing to the fifth activation timing. In addition, the determination portion 82*a* restricts the actual engine revolution speed on the basis of the first temperature at the fourth activation timing. Needless to say, any one of the first activation timing to the fifth activation timing may be employed as the starting of the engine 29.

The change portion 82*b* changes the upper limitation revolution speed determined by the determination portion 82*a* on the basis of the temperature of the operation fluid after the starting of the engine 29 (hereinafter referred to a second temperature). The revolution control part 82*c* outputs the upper limitation revolution speed to the first control device 81, the upper limitation revolution speed being determined by the determination portion 82*a*, and thereby controls the engine 29 such that the actual revolution speed of the engine 29 does not exceed the upper limitation revolution speed.

In the embodiment, the second control device 82 is provided with the revolution control portion 82*c*. However, the first control device 81 may be provided with the revolution control portion 82*c* instead of that. In the case where the first control device 81 is provided with the revolution control portion 82*c*, the revolution control portion 82*c* refers to the upper limitation revolution speed determined by the determination portion 82*a*, and controls the actual speed of the engine 29 such that the actual revolution speed does not exceed the upper limitation revolution speed.

Referring to FIG. 8 and FIG. 9, the determination portion 82*a*, the change portion 82*b*, the revolution control portion 82*c*, and the storage portion 82*d* will be explained in detail below.

FIG. 8 is a view illustrating a relation between a start time of the engine (a start time), a fluid temperature, and an upper limitation value of the actual engine revolution speed (the upper limitation engine revolution speed).

The start time "0s" corresponds to the starting of the engine 29 (hereinafter referred to as an engine starting time). The start times "40s, 60s, 70s, 75s, 80s, and 85s" correspond to the elapsed times after the starting of the engine 29. Thus, in FIG. 8, the fluid temperature at the start time "0s" represents the first temperature, and the fluid temperatures at other than the start time "0s" represent the second temperature.

The storage portion 82*d* stores a first upper limit setting information and a second upper limit setting information as shown in FIG. 8. The first upper limit setting information shows a relation between the first temperature and the upper limitation revolution speed. The second upper limit setting information shows a relation between the second temperature and the upper limitation revolution speed. The first upper limit setting information may be data representing the relation between the first temperature and the upper limitation revolution speed in numerical values, and may be a control function (a formula) and the like for drawing the relation between the first temperature and the upper limitation revolution speed.

In addition, the second upper limit setting information may be data representing the relation between the second temperature and the upper limitation revolution speed in numerical values, and may be a control function (a formula) and the like for drawing the relation between the second temperature and the upper limitation revolution speed.

Meanwhile, the numerical values (the data) shown in FIG. 8 of the first upper limit setting information and the second upper limit setting information are one example. The first upper limit setting information and the second upper limit setting information stored in the storage portion 82*d* are not limited to those shown in FIG. 8.

The determination portion 82*a* refers to the first upper limit setting information at the fourth activation timing [at the engine starting (the start time is 0s)], for example. The determination portion 82*a* sets the upper limitation revolution speed to 1000 rpm as shown in the first upper limit setting information stored in the storage portion 82*d* in a case where the first temperature measured by the measurement device 85 is −20° C. or more.

In addition, the change portion 82*b* monitors the second temperature measured by the measurement device 85 after the engine is started. The change portion 82*b* refers to the second upper limit setting information. The change portion 82*b* changes the upper limitation revolution speed from 1000 rpm to 1250 rpm as shown in the second upper limit setting information stored in the storage portion 82*d* in a case where the second temperature is −19° C. rising 1° C. from the first temperature at the engine starting. The change portion 82*b* increases the upper limitation revolution speed in the case where the second temperature becomes higher than the first temperature.

In addition, the change portion 82*b* increases the upper limitation revolution speed from 1250 rpm to 1500 rpm in a case where the second temperature becomes −18° C. after the engine starting, rising 2° C. from the first temperature at the engine starting. Moreover, the change portion 82*b* increases the upper limitation revolution speed from 2500 rpm to 1500 rpm that is the maximum revolution speed of the engine in a case where the second temperature becomes −14° C. after the engine starting, rising 6° C. from the first temperature at the engine starting.

That is, in a case a temperature difference between the first temperature and the second temperature is 1° C., the change portion 82*b* determines the upper limitation revolution speed after being changed (hereinafter referred to as a changed upper limitation revolution speed) by adding 250 rpm to the upper limitation revolution speed at the engine starting (hereinafter referred to as a starting upper limitation revolution speed). In addition, in a case the temperature difference is 2° C., the change portion 82*b* determines the changed upper limitation revolution speed by adding 500 rpm to the starting upper limitation revolution speed.

That is, the change portion 82*b* obtains the changed upper limitation revolution speed in accordance with an equation "the changed upper limitation revolution speed=the starting upper limitation revolution speed+(250 rpm×the temperature difference)". In other words, the change portion 82*b* changes an increment of the upper limitation revolution speed in accordance with the temperature difference between the first temperature and the second temperature.

In the case where the second control device 82 is provided with the revolution control portion 82*c*, the upper limitation revolution speed is outputted to the first control device 81. The first control device 81 controls the revolution speed of the engine 29 such that the revolution speed does not exceed the upper limitation revolution speed in accordance with the control order issued from the revolution control portion 82*c*.

Or, in the case where the first control device 81 is provided with the revolution control portion 82*c*, the revolution control portion 82*c* refers to the upper limitation revolution speed determined by the determination portion 82*a*, and then the revolution control portion 82*c* controls the revolution speed of the engine 29 such that the revolution speed does not exceed the upper limitation revolution speed.

For example, when the determination portion 82*a* sets the upper limitation revolution speed to 1000 rpm, the first control device 81 (the revolution control portion 82*c*) controls the engine such that the actual engine revolution speed becomes equal to the engine revolution speed corresponding to the operation amount in a case where the target engine revolution speed is less than 1000 rpm, the target engine revolution speed corresponding to the operation amount detected by the sensor 83*b* of the ordering member 83.

The first control device 81 (the revolution control portion 82*c*) fixes the actual engine revolution speed to 1000 rpm when the target engine revolution speed is equal to or more than 1000 rpm, the target engine revolution speed corresponding to the operation amount detected by the sensor 83*b* of the ordering member 83.

In addition, when the change portion 82*b* sets the upper limitation revolution speed to 2500 rpm that is the maximum revolution speed, the first control device 81 (the revolution control portion 82*c*) controls the engine such that the actual engine revolution speed becomes equal to the target engine revolution speed corresponding to the operation amount detected by the sensor 83*b* of the ordering member 83.

Meanwhile, in a case where the engine is started without the restriction of the upper limitation revolution speed of the engine 29 (under the state where the actual engine revolution speed can be increased to the maximum revolution speed), the actual engine revolution speed may reach the maximum revolution speed just after the engine 29 is started, and thus the outputs (output amounts) of the hydraulic pumps (the first hydraulic pump P1 and the second hydraulic pump P2) may be extremely high (large).

In the case where the actual engine revolution speed reaches the maximum revolution speed just after the engine is started under the state where the first temperature is low and thus the viscosity of the operation fluid is high, the output amounts of the hydraulic pumps are extremely large, and thus the extremely high pressures are applied to the hydraulic devices.

The work machine 1 according to the embodiment includes the determination portion 82*a*, the change portion 82*b*, and the revolution control portion 82*c*. In this manner, in the case where the fluid temperature (the first temperature) is low and the viscosity of the operation fluid is high at the start of the engine, the upper limitation revolution speed is suppressed, and thereby reducing the pressures applied to the hydraulic devices at the low temperature (hereinafter the pressures being referred to as a low-temperature pressure).

In addition, in the case where the fluid temperature (the second temperature) is increased in comparison with the fluid temperature at the start of the engine, the actual engine revolution speed is gradually increased, and thereby the outputs of the hydraulic pumps (the first hydraulic pump P1 and the second hydraulic pump P2) can be increased in accordance with the increasing of the actual engine revolution speed. In this manner, the working can be carried out without deteriorating the operability of the work machine.

In the embodiment described above, the first upper limit setting information and the second upper limit setting information (the relation between the first temperature, the second temperature, and the upper limitation revolution speed) are set regardless of an error of the measurement device (the temperature sensor) 85. However, the upper limitation revolution speed may be set corresponding to a measurement error (the error) of the temperature sensor 85 as shown in FIG. 9.

FIG. 9 shows the upper limitation revolution speeds of the cases where the error of the temperature sensor 85 is ±0° C., where the error of the temperature sensor 85 is ±2° C., and where the error of the temperature sensor 85 is −2° C. In a case where the error of the temperature sensor 85 is +2° C., a value of the upper limitation revolution speed at the identical temperatures (the first temperature, the second temperature) is set to be higher than the value of the upper limitation revolution speed in the error ±0° C.

Meanwhile, in a case where the error of the temperature sensor 85 is −2° C., a value of the upper limitation revolution speed at the identical temperatures (the first temperature, the second temperature) is set to be lower than the value of the upper limitation revolution speed in the error −0° C. That is, the error of the temperature sensor 85 is on the plus side (+ side), the upper limitation revolution speed is set to be higher than that of the case, error free. And, the error of the temperature sensor 85 is on the minus side (− side), the upper limitation revolution speed is set to be lower than that of the case, error free.

Meanwhile, the error of the temperature sensor 85 is a unique value fixed in the temperature sensor 85, and the first upper limit setting information and the second upper limit setting information (the relation between the first temperature, the second temperature, and the upper limitation revolution speed) is chosen in accordance with the error of the temperature sensor 85 attached to the work machine 1.

For example, in the case where the error of the temperature sensor 8 attached to the work machine 1 is +2° C., the determination portion 82*a* and the change portion 82*b* obtain the upper limitation revolution speed with use of the first upper limit setting information and the second upper limit setting information each corresponding to the error +2° C.

In that case, the unique error of the temperature sensor 8 attached to the work machine 1 is preliminarily stored in the storage 82*d*. And, the determination portion 82*a* and the change portion 82*b* choice the first upper limit setting information and the second upper limit setting information each corresponding to the error on the basis of the error stored in the storage portion 82*d*.

Or, the storage portion 82*d* may store the first upper limit setting information and the second upper limit setting information each corresponding to the largest error among the errors of the plurality of temperature sensors 85 employed in the work machine 1. And, the determination portion 82*a* and the change portion 82*b* obtain the upper limitation revolution speed with use of the first upper limit setting information and the second upper limit setting information each stored in the storage portion 82*d*.

In this manner, the upper limitation revolution speed is set corresponding to the error of the temperature sensor 85, and thus the upper limitation revolution speed can be set on the basis of the first temperature at the start of the engine even when the temperature sensor 85 has the measurement error, for example. Thus, the low-temperature pressure of the hydraulic device can be reduced at the start of the engine.

The work machine according to the embodiment is capable of restricting the upper limitation of the revolution speed of the prime mover, and thereby the operability of the work machine is prevented from deteriorating for a long time.

(Second Embodiment)

FIG. 10 is a view illustrating a first upper limit setting information and a second upper limit setting information according to a second embodiment of the present invention. In the work machine according to the second embodiment, explanations of the configurations similar to the configurations of the work machine according to the first embodiment described above will be omitted below.

The second control device 82 includes the determination portion 82*a*, the change portion 82*b*, the revolution control portion 82*c*, and the storage portion 82*d*. Referring to FIG. 10, the determination portion 82*a*, the change portion 82*b*, the revolution control portion 82*c*, and the storage portion 82*d* will be explained in detail below.

FIG. 10 is a view illustrating a relation between a start time of the engine (a start time), a fluid temperature, and an upper limitation value of the actual engine revolution speed.

The storage portion 82*d* stores the first upper limit setting information and the second upper limit setting information as shown in FIG. 10. The first upper limit setting information shows a relation between the first temperature and the upper limitation revolution speed. The second upper limit setting information shows a relation between the second temperature and the upper limitation revolution speed. Meanwhile, the numerical values (data) of the first upper limit setting information and the second upper limit setting information shown in FIG. 10 are exemplified as one example, and thus the first upper limit setting information and the second upper limit setting information stored in the storage portion 82*d* are not limited to those shown in FIG. 10.

As shown in FIG. 10, the first upper limit setting information prepares a plurality of the first temperatures, six temperatures, −24° C., −22° C., −20° C., −18° C., −16° C., and −14° C., for example. The determination portion 82*a* sets the upper limitation revolution speed (the starting upper limitation revolution speed) to 1000 rpm in all of the first temperatures at the engine start, −24° C., −22° C., −20° C., −18° C., −16° C., and −14° C.

In the case where the first temperature is −24° C., the change portion 82*b* increases the upper limitation revolution speed by 188 rpm in every time when the second temperature rises 1° C. with respect to the second temperature.

In the case where the first temperature is −22° C., the change portion 82*b* increases the upper limitation revolution speed by 214 rpm in every time when the second temperature rises 1° C. with respect to the second temperature.

In the case where the first temperature is −20° C., the change portion 82*b* increases the upper limitation revolution speed by 250 rpm in every time when the second temperature rises 1° C. with respect to the second temperature.

As described above, in the case where the plurality of first temperatures are prepared, the higher the first temperature is, the larger the increment of the upper limitation revolution speed corresponding to a temperature difference (an increment per a unit of the temperature difference) is set to be by the change portion 82*b*.

In this manner, the higher the first temperature is, the larger the increment of the upper limitation revolution speed is. Thus, when the fluid temperature is relatively high at the engine start, the engine revolution speed can rapidly reach the maximum revolution speed in accordance with the fluid temperature after the engine start. And, when the fluid temperature is relatively low at the engine start, the engine revolution speed can gradually reach the maximum revolution speed in accordance with the fluid temperature after the engine start. In this manner, the pressure is reduced in the low temperature, and the operability is improves.

In addition, the change portion 82*b* sets the upper limitation revolution speed to the maximum revolution speed of the engine in a case where the temperature difference between the first temperature and the second temperature is a predetermined value.

For example, the change portion 82*b* sets the upper limitation revolution speed to the maximum revolution speed of the engine in a case where the temperature difference is 8° C. or more when the first temperature is −24° C.

For example, the change portion 82*b* sets the upper limitation revolution speed to the maximum revolution speed of the engine in a case where the temperature difference is 3° C. or more when the first temperature is −14° C.

According to the embodiment mentioned above, in the case where the fluid temperature (the first temperature) is low and the viscosity of the operation fluid is high at the start of the engine, the determination portion 82*a* and the change portion 82*b* set the upper limitation revolution speed corresponding to the first temperature and the second temperature. In this manner, the pressures applied to the hydraulic devices at the low temperature is reduced.

Especially, the embodiment reduces influence of the error of the temperature sensor 85 as much as possible even when the temperature sensor 85 has the measurement error.

FIG. 11 is a view illustrating summary of FIG. 10 setting the error of the temperature sensor 85 to the similar errors of FIG. 9 within the temperature range from −20° C. to −14° C. similar to FIG. 9 in the first upper limit setting information and the second upper limit setting information shown in FIG. 10.

Figure 3:
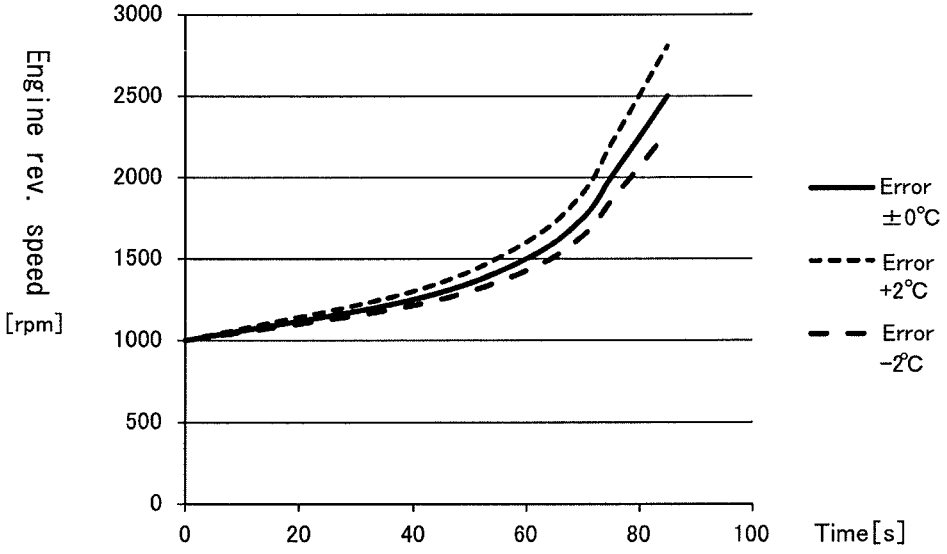
FIG. 3 is a view illustrating a relation between a fluid temperature, an upper limitation revolution speed, and an error of a temperature sensor in FIG. 11 according to a second embodiment of the present invention.

FIG. 3 is a view illustrating a graph of a relation between the start time shown in FIG. 11, the fluid temperatures (the first temperature and the second temperature), the upper limitation revolution speed, and the error of the temperature sensor 85. In addition, FIG. 4 is a view illustrating a graph of a relation between the fluid temperatures (the first temperature and the second temperature) in FIG. 9, the upper limitation revolution speed, and the error of the temperature sensor 85.

Figure 4:
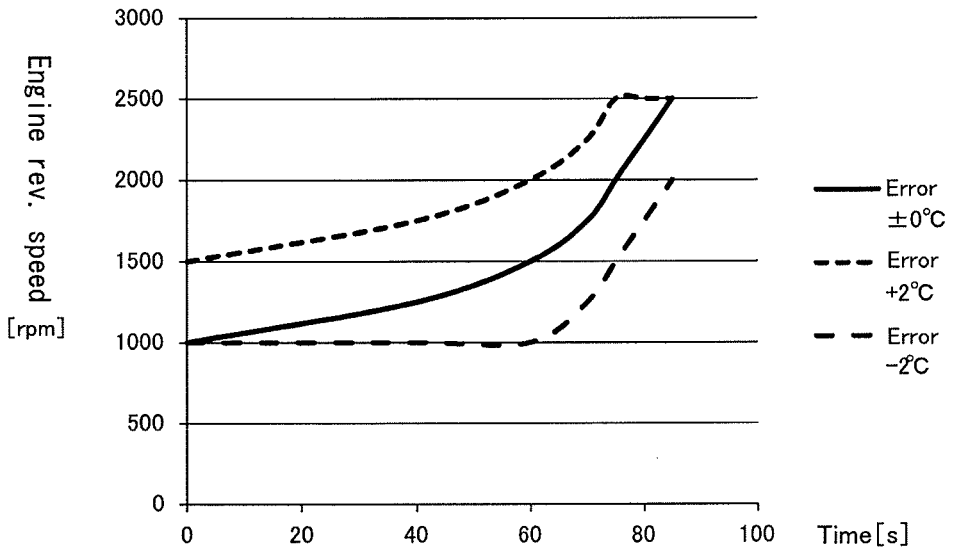
FIG. 4 is a view illustrating a relation between a fluid temperature, an upper limitation revolution speed, and an error of a temperature sensor in FIG. 9 according to the first embodiment.

As shown in FIG. 4, in the case where the temperature sensor 85 has an measurement error, a difference between the upper limitation revolution speeds at the identical elapsed times (times) is large influenced by the measurement error in the first embodiment. On the other hand, even in the case where the temperature sensor 85 has the measurement error, the difference between the upper limitation revolution speeds at the identical elapsed times (times) is small compared with the difference of FIG. 4 in the second embodiment.

In this manner, the second control device 82 according to the second embodiment is capable of reducing the influence of the measurement error unique for the temperature sensor 85, and thus the upper limitation revolution speed can be adequately restricted under the small influence of the measurement error.

Meanwhile, the method for restricting the upper limitation of the engine revolution speed on the basis of the temperature of the operation fluid (the fluid temperature) includes a method (a modified example) for changing, in every fluid temperature, a relation between the revolution speed of the engine (the target engine revolution speed) and the operation amount of the ordering member 83 (the acceleration lever, the acceleration pedal, the dial, and the like).

Figure 5:
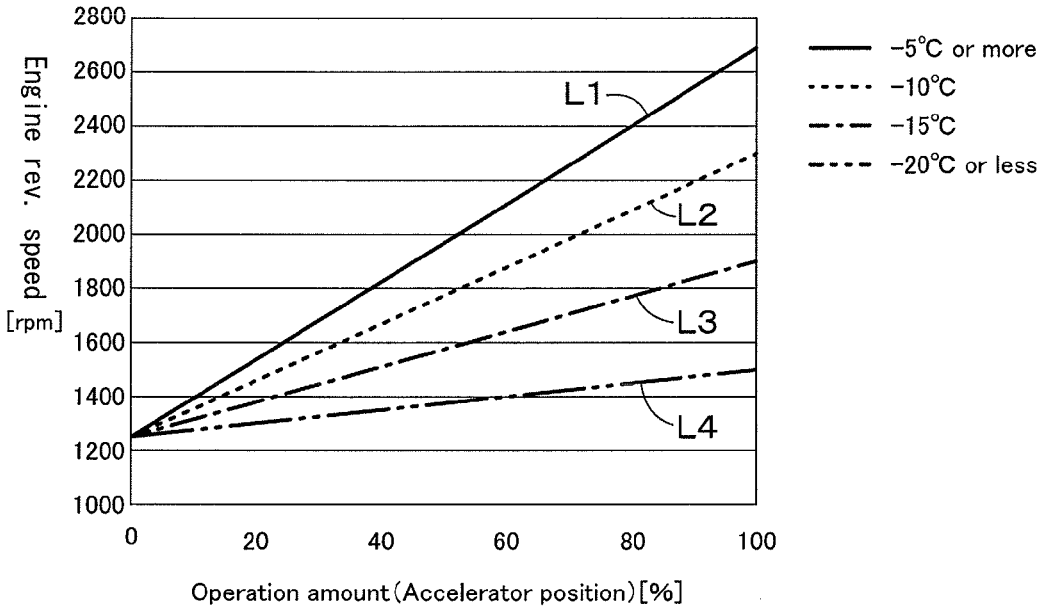
FIG. 5 is a view illustrating a relation between an operation amount, an engine target revolution speed, and a fluid temperature according to the second embodiment.

FIG. 5 is a view illustrating a relation between the operation amount of the ordering member 83, the engine target revolution speed, and the fluid temperature. The operation amount is indicated by an aperture (an accelerator position) (%). In a case where the ordering member 83 is not operated, the aperture is 0%, and in a case where the ordering member 83 is fully operated (the maximum operation), the aperture is 100%.

The relation between the operation amount, the target engine revolution speed, and the fluid temperature shown in FIG. 5, that is, data representing the control lines mentioned above are stored in the first control device 81. The first control device 81 sets the target engine revolution speed on the basis of the operation amount, the target engine revolution speed, and the fluid temperature. That is, the first control device 81 monitors the fluid temperature measured by the temperature sensor 85, and changes the target engine revolution speed on the basis of the fluid temperature, the target engine revolution speed being ordered by the ordering member 83.

As shown in FIG. 5, a control line L1 represents a relation between the target engine revolution speed and the operation amount of the ordering member 83 of a case where the fluid temperature is −5° C. or more.

A control line L2 represents a relation between the target engine revolution speed and the operation amount of the ordering member 83 of a case where the fluid temperature is equal to −10° C.

A control line L3 represents a relation between the target engine revolution speed and the operation amount of the ordering member 83 of a case where the fluid temperature is equal to −15° C.

A control line L4 represents a relation between the target engine revolution speed and the operation amount of the ordering member 83 of a case where the fluid temperature is equal to −20° C.

The control lines L1, L2, L3, and IA are lines representing the proportional relation between the operation amount and the target engine revolution speed. In the control lines L1, L2, L3, and L4, the maximum value of the target engine revolution speed of the case where the ordering member 83 is fully operated are set to be L1 >L2 >L3 >L4. That is, the maximum value of the target engine revolution speed is reduced in accordance with reduction of the fluid temperature.

In addition, as shown in FIG. 5, the lower the fluid temperature is, the smaller a slope of the control line becomes in the case where the fluid temperature is low and the viscosity is low. In this manner, the pressure applied to the hydraulic device can be set to be small.

Moreover, only the relation between the target engine revolution speed and the operation amount of the ordering member 83 is changed, and thus the operation feeling is not deteriorated in the operation of the work machine (the ordering member 83), thereby providing a comfortable operation to the operator of the work machine.

In addition, the higher the fluid temperature is, the larger the slope of the control line becomes, and thus the operation feeling is not deteriorated in the operation of the work machine (the ordering member 83) in view of that configurations, thereby providing a comfortable operation to the operator of the work machine.

Meanwhile, the four control lines are explained in the embodiment mentioned above. However, the control lines may be created for every 1° C. of the fluid temperature, and the target engine revolution speed may be controlled on the basis of the control lines.

The work machine according to the embodiment is capable of restricting the upper limitation of the revolution speed of the prime mover, and thereby the operability of the work machine is prevented from deteriorating for a long time.

(Third Embodiment)

FIG. 12 is a view illustrating a relation between the first temperature and the second temperature according to a third embodiment of the present invention. In the work machine according to the third embodiment, explanations of the configurations similar to the configurations of the work machine according to the embodiments described above will be omitted below.

The second control device 82 includes the determination portion 82*a*, the change portion 82*b*, the revolution control portion 82*c*, and the storage portion 82*d*. Referring to FIG. 12, the determination portion 82*a*, the change portion 82*b*, the revolution control portion 82*c*, and the storage portion 82*d* will be explained in detail below.

The storage portion 82*d* stores a relation between the first temperature and the second temperature as shown in FIG. 12. Meanwhile, the numerical values (data) of the first temperature and the second temperature shown in FIG. 12 are exemplified as one example, and thus the first temperature and the second temperature stored in the storage portion 82*d* are not limited to those shown in FIG. 12.

As shown in FIG. 12, a plurality of the relations between the first temperature and the second temperature are prepared. A difference between the first temperature and the second temperature is 15° C. The determination portion 82*a* sets the upper limitation revolution speed (the starting upper limitation revolution speed) in accordance with the first temperature at the start of the engine.

For example, the determination portion 82*a* sets the upper limitation revolution speed to 1000 rpm in the case where the first temperature is −20° C. The determination portion 82*a* sets the upper limitation revolution speed to 1000 rpm or more in the case where the first temperature is larger than −20° C. The determination portion 82*a* sets the upper limitation revolution speed to less than 1000 rpm in the case where the first temperature is less than −20° C.

Meanwhile, the upper limitation revolution speed may be fixed to 1000 rpm regardless of the first temperature at the start of the engine.

The change portion 82*b* releases the setting of the upper limitation revolution speed when the second temperature corresponds to the first temperature. For example, in the case where the first temperature is −10° C., the change portion 82*b* releases the setting of the upper limitation revolution speed when the second temperature becomes 5° C. That is, the change portion 82*b* releases the setting of the upper limitation revolution speed when the second temperature is higher by 15° C. than the first temperature as shown in FIG. 12.

Meanwhile, the difference between the first temperature and the second temperature is fixed to 15° C. in the FIG. 12. However, the difference between the first temperature and the second temperature may be not fixed but variable as shown in FIG. 13.

Thus, the relation between the first temperature and the second temperature is defined, and the change portion 82*b* releases the setting of the upper limitation revolution speed. In this manner, the setting of the upper limitation revolution speed can be released in accordance with the condition at the start of the engine, and then after the releasing, the first control device 81 is capable of increasing the engine revolution speed gradually to the target revolution speed set by the ordering member 83.

For example, the engine revolution speed is increased after the releasing of the upper limitation revolution speed in steps of +100 rpm.

The work machine according to the embodiment is capable of restricting the upper limitation of the revolution speed of the prime mover, and thereby the operability of the work machine is prevented from deteriorating for a long time.

In the above description, the embodiment of the present invention has been explained. However, all the features of the embodiments disclosed in this application should be considered just as examples, and the embodiments do not restrict the present invention accordingly. A scope of the present invention is shown not in the above-described embodiments but in claims, and is intended to include all modifications within and equivalent to a scope of the claims.

For example, the first control device 81 and the second control device 82 may be integrated or may be incorporated in one body. In addition, the first control device 81 may include the determination portion 82*a*, the change portion 82*b*, the revolution control portion 82*c*, and the storage portion 82*d* that are included in the second control device 82.

What is claimed is:

1. A work machine comprising:

a prime mover;

a hydraulic pump configured to be operated by the prime mover and outputting an operation fluid;

a hydraulic device configured to operate via the operation fluid;

a measurement sensor configured to measure a first temperature and a second temperature, the first temperature being a temperature of the operation fluid at starting of the prime mover, the second temperature being a temperature of the operation fluid after the starting of the prime mover; and a controller configured to:

utilize a predetermined starting upper limitation revolution speed as an upper limit revolution speed at the starting of the prime mover, the upper limit revolution speed being an upper limit of a revolution speed of the prime mover;

change, after the starting of the prime mover, the upper limit revolution speed to a changed upper limitation revolution speed obtained by adding a correction value to the starting upper limitation revolution speed, the correction value being obtained by multiplying a temperature difference between the first temperature and the second temperature by a predetermined correction revolution speed; and the controller including a revolution controller configured to control the revolution speed of the prime mover based on the starting upper limitation revolution speed at the starting of the prime mover and to control the revolution speed of the prime mover based on the changed upper limitation revolution speed after the starting of the prime mover.

2. The work machine according to claim 1, wherein the controller sets the starting upper limitation revolution speed to be higher compared to a case where the measurement sensor has no measurement error when the measurement sensor has the measurement error on a plus side, and wherein the controller sets the starting upper limitation revolution speed to be lower compared to a case where the measurement sensor has no measurement error when the measurement sensor has the measurement error on a minus side.

3. The work machine according to claim 2, wherein the controller sets the changed upper limitation revolution speed to be higher compared to a case where the measurement sensor has no measurement error when the measurement sensor has the measurement error on a plus side, and wherein the controller sets the changed upper limitation revolution speed to be lower compared to a case where the measurement sensor has no measurement error when the measurement sensor has the measurement error on a minus side.

4. The work machine according to claim 1, wherein the controller sets the changed upper limitation revolution speed to be higher compared to a case where the measurement sensor has no measurement error when the measurement sensor has the measurement error on a plus side, and wherein the controller sets the changed upper limitation revolution speed to be lower compared to a case where the measurement sensor has no measurement error when the measurement sensor has the measurement error on a minus side.

5. The work machine according to claim 4, comprising:

a storage configured to store information related to a first upper limit setting including the starting upper limitation revolution speed and information related to a second upper limit setting information including the correction revolution speed, wherein the controller utilizes the starting upper limitation revolution speed as the upper limit revolution speed based on the first upper limit setting, and wherein the controller calculates the correction value by multiplying the temperature difference between the first temperature and the second temperature by the correction revolution speed based on the second upper limit setting.

6. A work machine comprising:

a prime mover;

a hydraulic pump configured to be operated by the prime mover and outputting an operation fluid;

a hydraulic device configured to be operated by the operation fluid;

a measurement sensor configured to measure a first temperature and a second temperature, the first temperature being a temperature of the operation fluid at starting of the prime mover, the second temperature being a temperature of the operation fluid after the starting of the prime mover; and a controller configured to:

utilize a predetermined starting upper limitation revolution speed as an upper limit revolution speed at starting of the prime mover, the upper limit revolution speed being an upper limit of a revolution speed of the prime mover;

change, after the starting of the prime mover, the upper limit revolution speed to a changed upper limitation revolution speed obtained by adding a correction value to the starting upper limitation revolution speed, the correction value being obtained by multiplying a temperature difference between the first temperature and the second temperature by a correction revolution speed set per a unit of the temperature difference; and the controller including a revolution controller configured to control the revolution speed of the prime mover based on the starting upper limitation revolution speed at starting of the prime mover and to control the revolution speed of the prime mover based on the changed upper limitation revolution speed after the starting of the prime mover.

7. The work machine according to claim 6, wherein the correction revolution speed is set based on the first temperature and is configured to vary depending on the first temperature.

8. The work machine according to claim 7, wherein the correction revolution speed is configured to increase when the first temperature increases.

9. The work machine according to claim 8, wherein the controller sets the starting upper limitation revolution speed to be higher compared to a case where the measurement sensor has no measurement error when the measurement sensor has the measurement error on a plus side, and wherein the controller sets the starting upper limitation revolution speed to be lower compared to a case where the measurement sensor has no measurement error when the measurement sensor has the measurement error on a minus side.

10. The work machine according to claim 9, wherein the controller sets the changed upper limitation revolution speed to be higher compared to a case where the measurement sensor has no measurement error when the measurement sensor has the measurement error on a plus side, and wherein the controller sets the changed upper limitation revolution speed to be lower compared to a case where the measurement sensor has no measurement error when the measurement sensor has the measurement error on a minus side.

11. The work machine according to claim 8, wherein the controller sets the changed upper limitation revolution speed to be higher compared to a case where the measurement sensor has no measurement error when the measurement sensor has the measurement error on a plus side, and wherein the controller sets the changed upper limitation revolution speed to be lower compared to a case where the measurement sensor has no measurement error when the measurement sensor has the measurement error on a minus side.

12. The work machine according to claim 11, comprising a storage configured to store information related to a first upper limit setting including the starting upper limitation revolution speed and information related to a second upper limit setting information representing a relation between the first temperature and the correction revolution speed, wherein the controller utilizes the starting upper limitation revolution speed as the upper limit revolution speed based on the first upper limit setting, and wherein the controller calculates the correction value by multiplying the temperature difference between the first temperature and the second temperature by the correction revolution speed based on the second upper limit setting.

* * * * *